US009261285B2

(12) United States Patent
Setsu et al.

(10) Patent No.: US 9,261,285 B2
(45) Date of Patent: Feb. 16, 2016

(54) AIR CONDITIONER

(75) Inventors: Michio Setsu, Osaka (JP); Takanori Oka, Osaka (JP); Hirokazu Uemae, Osaka (JP); Keisuke Uchida, Osaka (JP)

(73) Assignee: SHARP KABUSHIKI KAISHA, Osaka (JP)

( * ) Notice: Subject to any disclaimer, the term of this patent is extended or adjusted under 35 U.S.C. 154(b) by 1024 days.

(21) Appl. No.: 12/581,714

(22) Filed: Oct. 19, 2009

(65) Prior Publication Data

US 2010/0212861 A1 Aug. 26, 2010

(30) Foreign Application Priority Data

Feb. 24, 2009 (JP) ..... 2009-040146
Feb. 24, 2009 (JP) ..... 2009-040150
Feb. 24, 2009 (JP) ..... 2009-040158

(51) Int. Cl.

*F25B 29/00* (2006.01)
*F28D 1/00* (2006.01)
*F24F 1/02* (2011.01)
*F24F 13/30* (2006.01)

(52) U.S. Cl.

CPC ..... *F24F 1/027* (2013.01); *F24F 13/30* (2013.01)

(58) Field of Classification Search

CPC .. F24H 2250/04; F24H 3/0411; F28F 9/0273; F28F 9/026; F24F 1/02; F24F 2221/34; F24F 1/027; F24F 13/30

USPC ..... 165/48.1, 58, 59, 61, 64, 65; 219/200, 219/520, 523, 525, 530, 526, 531, 541, 540, 219/542, 538, 539, 546; 248/220.21; 180/68.4

See application file for complete search history.

(56) References Cited

U.S. PATENT DOCUMENTS

| | | | | | |
|---|---|---|---|---|---|
| 3,387,866 | A * | 6/1968 | Baldwin | 285/184 |
| 4,394,563 | A * | 7/1983 | Schnell | 392/373 |
| 4,663,910 | A * | 5/1987 | Hasan | 52/410 |
| 4,763,723 | A * | 8/1988 | Granetzke | 165/67 |
| 5,198,640 | A * | 3/1993 | Yang | 219/530 |
| 5,372,189 | A * | 12/1994 | Tsunekawa et al. | 62/262 |
| 5,544,714 | A * | 8/1996 | May et al. | 180/68.4 |
| 5,578,232 | A * | 11/1996 | Engelke | 219/532 |
| 5,641,420 | A * | 6/1997 | Peterson et al. | 219/536 |
| 5,723,828 | A | 3/1998 | Nakagawa | |
| 6,040,557 | A * | 3/2000 | Prust et al. | 219/206 |
| 6,412,581 | B2 * | 7/2002 | Enomoto et al. | 180/68.4 |
| 6,664,514 | B1 * | 12/2003 | Marshall | 219/267 |
| 6,723,966 | B2 * | 4/2004 | Jiang | 219/505 |
| 6,745,589 | B2 | 6/2004 | Katatani et al. | |

(Continued)

FOREIGN PATENT DOCUMENTS

| | | | |
|---|---|---|---|
| CN | 1712792 | A | 12/2005 |
| JP | S60-39831 | U | 3/1985 |

(Continued)

*Primary Examiner* — Allen Flanigan
*Assistant Examiner* — Jason Thompson
(74) *Attorney, Agent, or Firm* — Birch, Stewart, Kolasch & Birch, LLP

(57) ABSTRACT

An air conditioner has: a casing 20 having an air inlet 21 and an air outlet 22; a heater 53 disposed in the casing 20 and heating air having flowed through the air inlet 21 into the casing 20; holders 54 and 55 holding the heater 53 and fitted to the casing 20; and a spacer 59 in contact with the heater 53 and disposed between the holders 54 and 55 and the heater 53. At least one of the heat-resistance and the flame-retardance of the spacer 59 is higher than that of the holders 54 and 55.

2 Claims, 18 Drawing Sheets

(56) References Cited

U.S. PATENT DOCUMENTS

| | | | | |
|---|---|---|---|---|
| 6,860,032 | B2 * | 3/2005 | Meyer | 34/225 |
| 7,508,663 | B2 * | 3/2009 | Coglitore | 361/695 |
| 7,667,166 | B2 * | 2/2010 | Zeyen et al. | 219/552 |
| 2003/0094010 | A1 * | 5/2003 | Katatani et al. | 62/259.1 |
| 2004/0087705 | A1 * | 5/2004 | Yagi et al. | 524/492 |
| 2004/0180620 | A1 * | 9/2004 | Sharp et al. | 454/184 |
| 2005/0205552 | A1 * | 9/2005 | Han et al. | 219/540 |
| 2006/0053598 | A1 * | 3/2006 | Kaczmarek et al. | 24/455 |
| 2008/0128401 | A1 * | 6/2008 | Bohlender et al. | 219/202 |
| 2008/0149613 | A1 * | 6/2008 | Ishinada | 219/267 |
| 2009/0026191 | A1 * | 1/2009 | Bohlender et al. | 219/520 |

FOREIGN PATENT DOCUMENTS

| | | | |
|---|---|---|---|
| JP | 61-085521 | A | 5/1986 |
| JP | 03-075422 | A | 3/1991 |
| JP | 05-071756 | A | 3/1993 |
| JP | 6-2886 | A | 1/1994 |
| JP | 08-048128 | A | 2/1996 |
| JP | 08-068490 | A | 3/1996 |
| JP | 2008-121952 | A | 5/2008 |
| JP | 2008-240463 | A | 10/2008 |

* cited by examiner

AIR CONDITIONER

This application claims priority under 35 U.S.C. §119(a) on Japanese Patent Application Nos. 2009-040146, 2009-040150, and 2009-040158 all filed on Feb. 24, 2009, the entire contents of which are hereby incorporated by reference.

BACKGROUND OF THE INVENTION

1. Field of the Invention

The present invention relates to an air conditioner.

2. Description of Related Art

A conventional air conditioner is disclosed in JP-A-H6-2886. The air conditioner is a one-unit type in which an indoor portion that is placed indoors is placed at the front, and an outdoor portion that is placed outdoors is placed at the back. The indoor portion and the outdoor portion are adjacent to each other via a partition wall. In the outdoor portion, a compressor that operates the refrigerating cycle is disposed. At the back of the outdoor portion, an outdoor heat exchanger connected to the compressor is disposed, and facing the outdoor heat exchanger, an outdoor fan for cooling the outdoor heat exchanger is provided.

At the front of the indoor portion, an air inlet is provided, and above the air inlet, an air outlet is provided. In the indoor portion, an air passage is formed by an air duct connecting the air inlet and the air outlet, and in the air passage, a blower fan is provided. Between the blower fan and the air inlet, an indoor heat exchanger connected to the compressor via a refrigerant pipe is disposed. Between the blower fan and the indoor heat exchanger, a heater unit having a plurality of tubular heaters is disposed.

When cooling operation starts, the compressor is driven to operate the refrigerating cycle, with the indoor heat exchanger serving as a cold-side evaporator of the refrigerating cycle, and the outdoor heat exchanger as a hot-side condenser. The outdoor heat exchanger is cooled by the outdoor fan to dissipate heat. As the blower fan is driven, the air inside the room flows through the air inlet into the air passage, and the air has its temperature lowered by heat exchange with the indoor heat exchanger, and is then blown into the room through the air outlet. In this way, the room is cooled.

When heating operation starts, the compressor is driven to operate the refrigerating cycle, with the indoor heat exchanger serving as the hot-side condenser of the refrigerating cycle and the outdoor heat exchanger as the cold-side evaporator. The temperature of the outdoor heat exchanger is raised by the outdoor fan. As the blower fan is driven, the air inside the room flows through the air inlet into the air passage, and has its temperature raised by heat exchange with the indoor heat exchanger. Moreover, the heater is driven to further raise the temperature of the air in the air passage. The air, having had its temperature raised, is blown out through the air outlet into the room to heat the room.

In a left part of the partition wall, a ventilation damper for introducing outside air into the room is provided in an openable/closable manner; in the rear surface of the air duct, an opening is provided. When the ventilation damper is opened while the blower fan is being driven, outside air flows through the ventilation damper, via the opening, into the air passage. The outside air having flowed in through the opening flows through the air passage and blows out through the air outlet. In this way, the room is ventilated.

According to the conventional air conditioner described above, however, the heater unit is a single unit having a plurality of heaters held by a resin-molded holder, and is fitted inside the casing of the indoor portion with the holder screwed to the casing. Here, the holder makes contact with the heaters, and thus needs to be heat-resistant (for example, 260° C. or above) and flame-retardant (for example, UL standard 94 rating 5V). Thus, as the material of the holder, expensive resin such as PPS (polyphenylene sulfide) resin is used, which disadvantageously increases the cost of the air conditioner.

Moreover, according to the conventional air conditioner described above, the heater unit is disposed in a position overlapping the blower fan as seen from above, and is fastened in the air passage with screws from the front. After the heater unit is fitted, the indoor heat exchanger is fitted at the front. Thus, when there is a failure with the heater, the indoor heat exchanger connected to the refrigerant pipe needs to be moved away so that the heater unit can be detached/attached from the front for replacement. This disadvantageously makes replacement of the heater unit troublesome and makes maintenance difficult.

Moreover, according to the conventional air conditioner described above, the ventilation duct is arranged lopsidedly toward the left; thus, while ventilating, the amount of outside air flowing into the air passage is larger near the ventilation duct than away from it. This disadvantageously causes the amount of air flowing through the air passage to be uneven between the left and right parts thereof.

SUMMARY OF THE INVENTION

An object of the present invention is to provide an air conditioner of which the cost can be reduced. Another object of the invention is to provide an air conditioner on which maintenance can be performed easily. Still another object of the invention is to provide an air conditioner in which an even amount of air flows through the left and right parts of an air passage.

To achieve the above objects, the invention comprises a casing having an air inlet and an air outlet; a heater disposed inside the casing to heat air having flowed through the air inlet into the casing; a holder holding the heater and fitted to the casing; and a spacer disposed between the holder and the heater to make contact with the heater, in which at least one of the heat-resistance and the flame-retardance is higher than that of the holder.

With this structure, the air in the room taken in through the air inlet has its temperature raised by the heater, and is then blown out through the air outlet. In this way, the room is heated. Preferably, the heater has its opposite ends held by the holder via the spacer and the holder is fixed with screws etc. to the casing such that the heater is arranged in a predetermined position. The spacer in contact with the heater is formed of material with high heat-resistance and high flame-retardance that does not deform or ignite even when the heating temperature of the heater is higher than during normal use due to abnormalities. Thanks to the provision of the spacer, the holder is not in direct contact with the heater, and thus less heat conducts to the holder than to the spacer. Thus, for the holder, it is possible to use material of which one or both of the heat-resistance and the flame-retardance are lower than the spacer. Here, the holder is formed of material with heat-resistance or flame-retardance lower than the spacer but with heat-resistance and flame-retardance high enough to prevent deformation or ignition against the heat conducted when the heating temperature of the heater is higher than during normal use due to abnormalities. Note that the heater may have a fin for heat exchange fixed to a heat generator generating heat.

Moreover, the invention comprises a casing having an air inlet and an air outlet; an outer cover covering the casing; an air passage connecting the air inlet and the air outlet; a blower fan disposed in the air passage; a heat exchanger arranged to face the air inlet and forming part of the refrigerating cycle to cool or heat air flowing in through the air inlet; and a heater unit facing the heat exchanger while holding, with a holder, a heater having a heat generator, and heating air flowing through the air inlet, in which the heater unit can be taken out and put in along the heat exchanger through a gap between the heater unit and the blower fan when the outer cover is removed.

With this structure, air inside the room that is taken in through the air inlet into the casing by driving of the blower fan is cooled or heated by the heat exchanger, and is blown into the room through the air outlet. In this way, indoor cooling operation or heating operation is performed. During the heating operation, the heater is driven and the air flowing through the air passage has its temperature raised further by the heat generator generating heat. It is also possible, during the heating operation, to stop the heat exchanger and perform heating with the heater alone. Preferably, the heater has its opposite ends held by the holder and the holder is fixed with screws etc. to the casing such that the heater unit is arranged in the gap between the heat exchanger and the blower fan. When there is a failure with the heater, the outer cover is removed and the heater unit is taken out and put in through the gap between the heat exchanger and the blower fan for replacement. Note that the heater may have a fin for heat exchange fixed to a heat generator generating heat.

Moreover, the invention comprises a casing having an air inlet and an air outlet; an air passage formed by an air duct connecting the air inlet and the air outlet; a blower fan disposed in the air passage; an indoor heat exchanger disposed in the air passage and forming part of the refrigerating cycle to cool or heat air flowing in through the air inlet; a ventilation damper disposed behind the air passage and letting outside air flow into the casing; and an opening provided in the rear surface of the air duct, the blower fan being driven to introduce outside air, having flowed through the ventilation damper into the casing, into the air passage via the opening to perform ventilation, in which the ventilation damper is arranged lopsidedly on one side in the left/right direction, and the opening area per unit area of the opening is larger at the downwind side than at the upwind side at the downstream side of the ventilation damper.

With this structure, air inside the room that is taken in through the air inlet into the casing by driving of the blower fan is cooled or heated by the heat exchanger, and is blown into the room through the air outlet. In this way, the room is cooled or heated. When the ventilation damper is opened, outside air is introduced into the casing by the blower fan. At the downstream side of the ventilation damper, the outside air flows evenly into the air passage through the upwind side where the opening area per unit area is small and the downwind side where the opening area per unit area is large.

Moreover, the present invention comprises a casing having an air inlet and an air outlet; an air passage formed by an air duct connecting the air inlet and the air outlet; a blower fan disposed in the air passage; a heat exchanger disposed in the air passage and forming part of the refrigerating cycle to cool or heat air flowing in through the air inlet; a ventilation damper disposed behind the air passage and letting outside air flow into the casing; and a plurality of openings provided in the rear surface of the air duct, the blower fan being driven to introduce outside air, having flowed through the ventilation damper into the casing, into the air passage via the openings to perform ventilation, in which the ventilation damper is arranged lopsidedly on one side in the left/right direction, and a plurality of divided paths that each introduce outside air into one of the openings are provided.

With this structure, the blower fan is driven to take in air inside the room through the air inlet into the air passage, which is then cooled or heated by the heat exchanger and blown into the room through the air outlet. In this way, the room is cooled or heated. When the ventilation damper is opened, outside air is introduced into the casing by the blower fan. At the downstream side of the ventilation damper, the outside air branches evenly to flow through the plurality of divided paths, through the open parts provided in the divided paths, into the air passage.

DETAILED DESCRIPTION OF THE INVENTION

Figure 1:
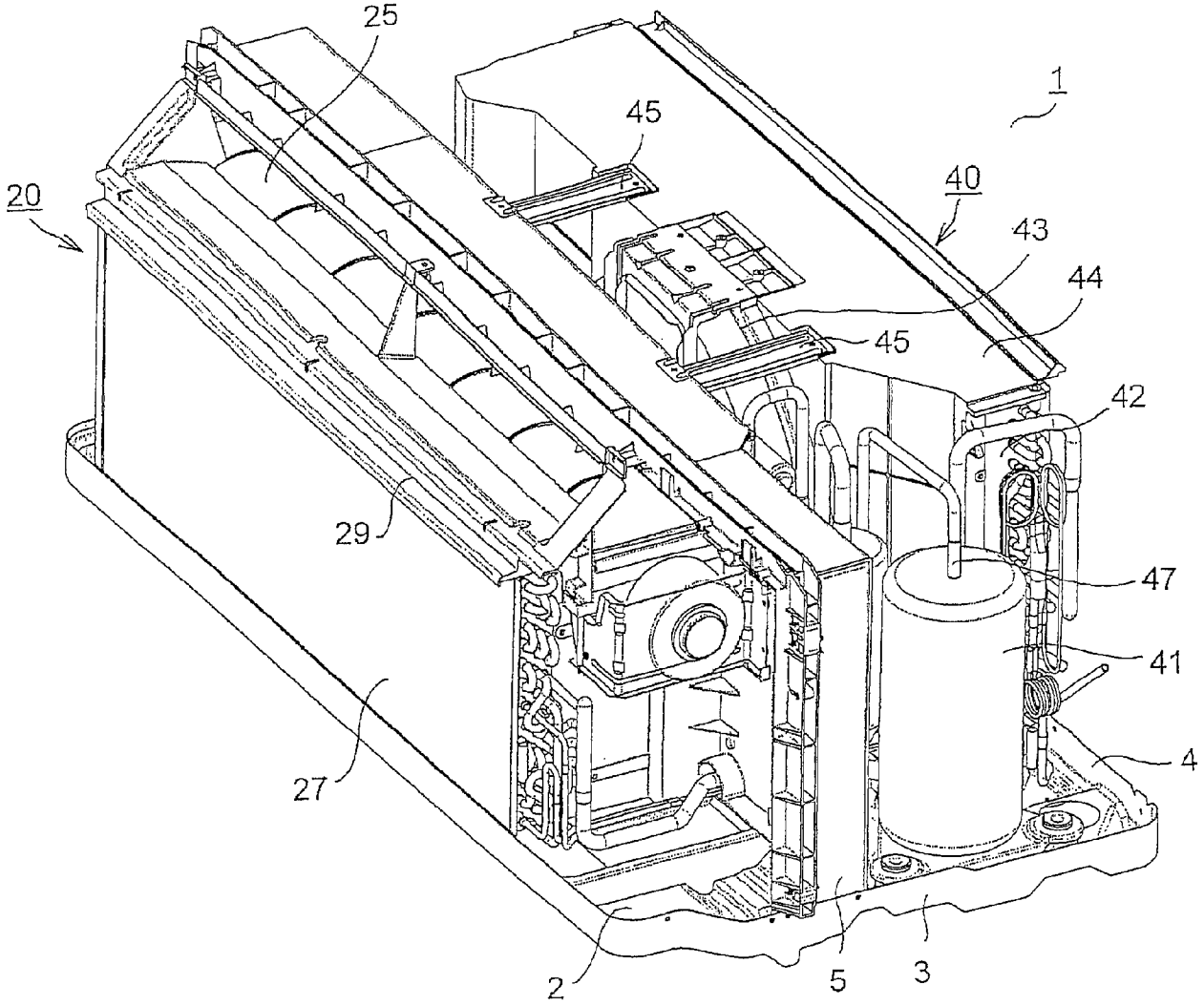
FIG. 1 is a perspective view as seen from in front of an air conditioner according to a first embodiment of the present invention.
Figure 2:
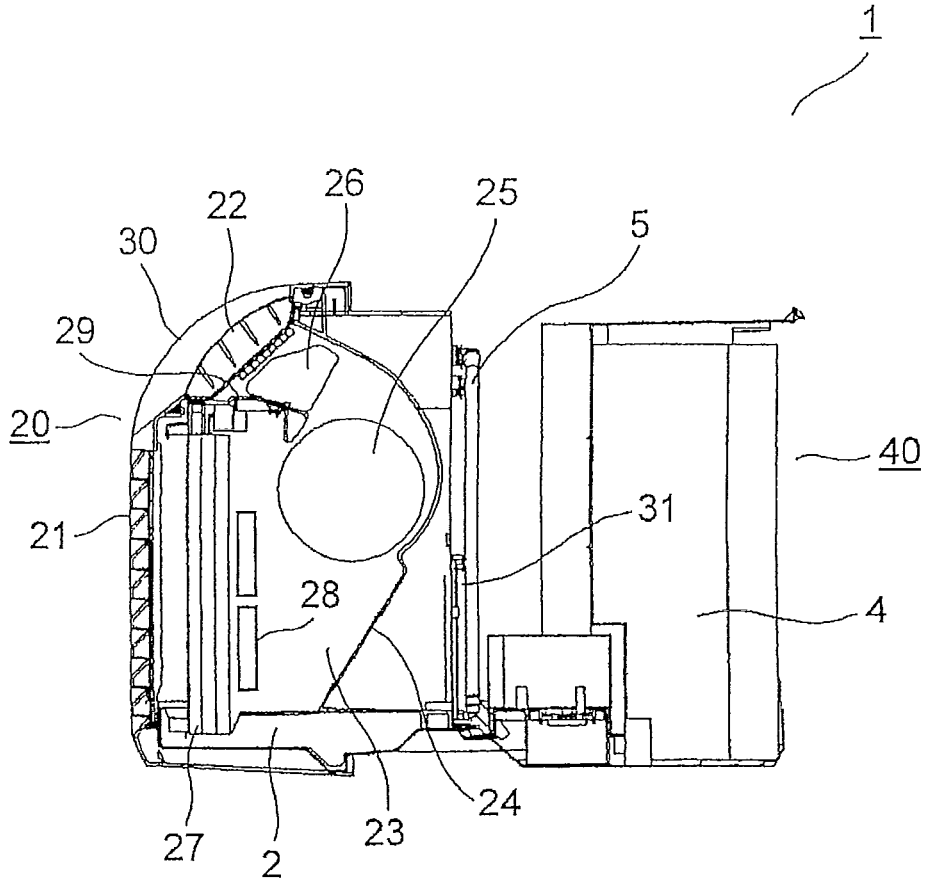
FIG. 2 is a sectional view as seen from the right side of the air conditioner according to the first embodiment of the invention.
Figure 3:
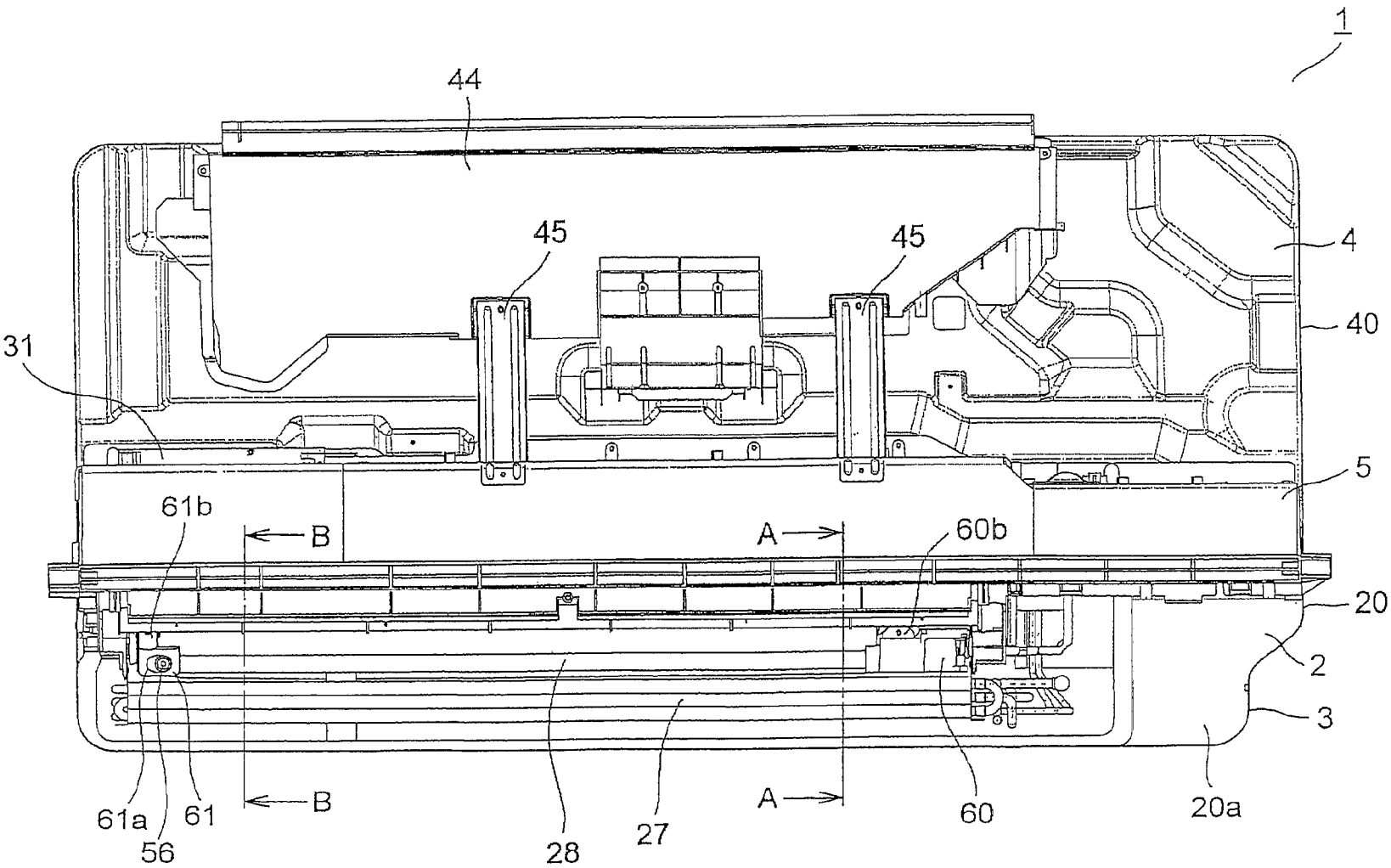
FIG. 3 is a top view of the air conditioner according to the first embodiment of the invention.
Figure 4:
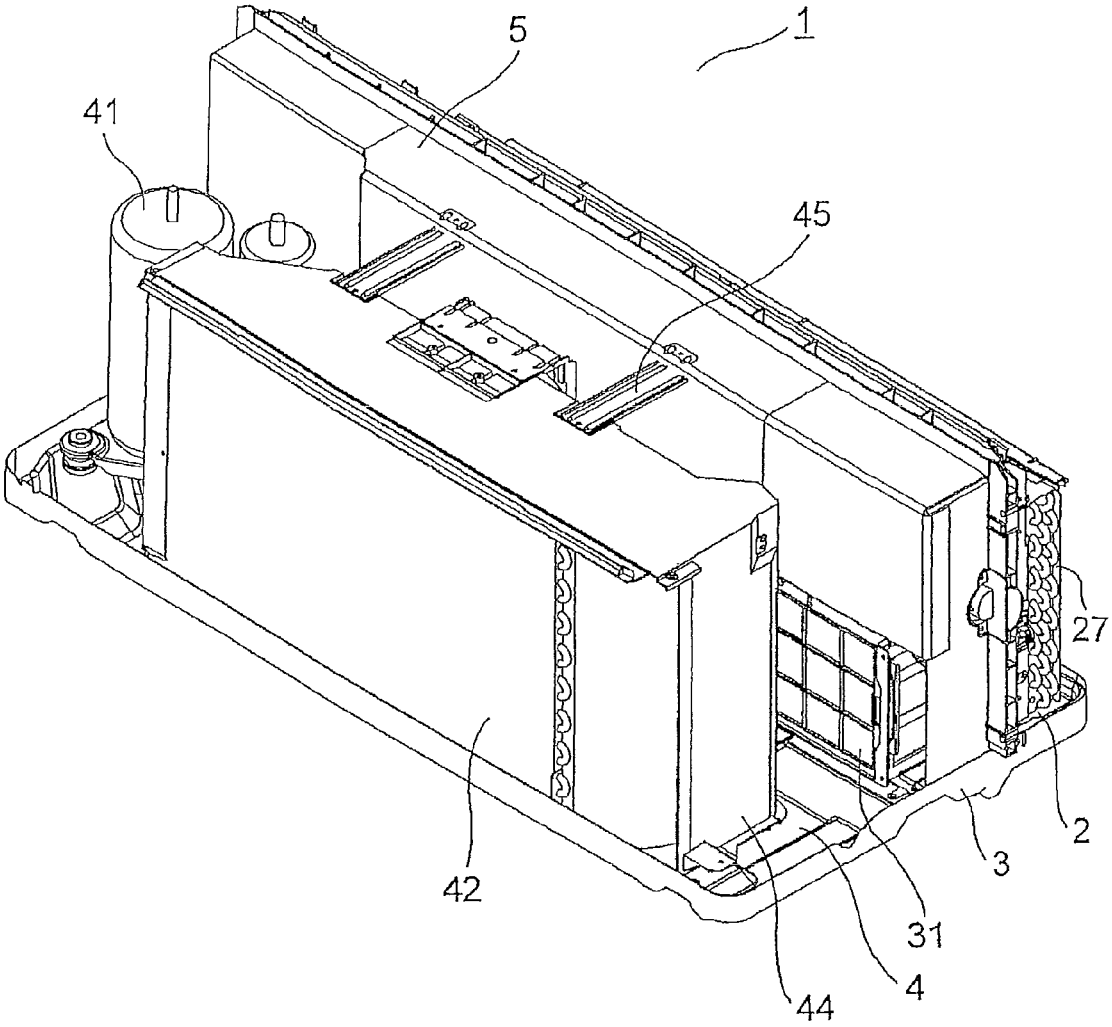
FIG. 4 is a perspective view as seen from behind of the air conditioner according to the first embodiment of the invention.

Hereinafter, embodiments of the present invention will be described with reference to the accompanying drawings. FIGS. 1, 2, 3, and 4 are, respectively, a perspective view as seen from in front, a sectional view as seen from the right side, a top view, and a perspective view as seen from behind, of an air conditioner according to a first embodiment. FIGS. 1, 3, and 4 show a state in which an outer cover 30 (see FIG. 2) is removed. The air conditioner 1 is a one-unit type having an indoor portion 2 that is placed indoor and an outdoor portion 4 that is placed outdoor to be adjacent to the indoor portion 2.

At the front of the indoor portion 2, an air inlet 21 is provided; at the front of the outdoor portion 4, an outdoor heat exchanger 42 is provided. In the following description, the air inlet 21 side will be referred to as the front side, and the outdoor heat exchanger 42 side will be referred to as the back side (rear side). In addition, the right hand side and the left hand side, as seen from in front of the air inlet 21, will be referred to as the right side and the left side, respectively, of the air conditioner 1.

The indoor portion 2 and the outdoor portion 4 are placed on a base plate 3, and are divided into a front and a rear portion by a partition wall 5. The indoor portion 2 forms a casing 20 which is enclosed by the base plate 3, the partition wall 5, and the outer cover 30. In a right end part inside the casing 20, an electrical portion 20*a* in which electrical components are arranged is provided. Likewise, the outdoor portion 4 forms a casing 40 enclosed by the base plate 3, the partition wall 5, and the outer cover (unillustrated).

In the outdoor portion 4, in a right end part thereof, a compressor 41 that operates the refrigerating cycle is disposed. At the back of the outdoor portion 4, an outdoor heat exchanger 42 connected to the compressor 41 via a refrigerant pipe 47 is disposed. An outdoor fan 43 comprising a propeller fan is disposed in a central part in the left/right direction to face the outdoor heat exchanger 42 to cool the outdoor heat exchanger 42. The outdoor fan 43 and the outdoor heat exchanger 42 are disposed inside a housing 44, and the housing 44 forms a duct that introduces an air stream from the outdoor fan 43 to the outdoor heat exchanger 42. The housing 44 is supported on the partition wall 5 via brackets 45.

In a left end part of the partition wall 5, there is provided a ventilation damper 31 that opens/closes and introduces outside air into the casing 20 of the indoor portion 2. Water condensed on an indoor heat exchanger 27, which will be described below, is drained onto the base plate 3, and part of the blades of the outdoor fan 43 is immersed in the condensed water collected on the base plate 3. The outdoor fan 43 rotates to disperse the condensed water toward the outdoor heat exchanger 42 so as to further cool the outdoor heat exchanger 42.

Here, if the ventilation damper 31 is arranged near the outdoor fan 43, the condensed water enters the indoor portion 2 via the ventilation damper 31. Thus, by arranging the ventilation damper 31 lopsidedly toward one end part in the left/right direction away from the outdoor fan 43, it is possible to prevent water from entering the indoor portion 2.

At the front of the outer cover 30 covering the indoor portion 2, the air inlet 21 is provided; above the air inlet 21, an air outlet 22 is provided. Inside the indoor portion 2, an air passage 23 is formed by an air duct 24 connecting the air inlet 21 and the air outlet 22. The air duct 24 has, at its top, a duct member 29 which can be attached/detached when the outer cover 30 is removed; the duct member 29 forms the lower wall near the air outlet 22 of the air passage 23.

In the air passage 23, a blower fan 25 comprising a cross-flow fan is provided. Near the air outlet 22 in the air passage 23, a louver 26 for adjusting the wind direction is provided. Between the blower fan 25 and the air inlet 21, the indoor heat exchanger 27 connected to the compressor 41 via the refrigerant pipe 47 is disposed. Between the blower fan 25 and the indoor heat exchanger 27, a heater unit 28 is disposed. The indoor heat exchanger 27 and the heater unit 28 are covered with the duct member 29 from above.

Figure 5:
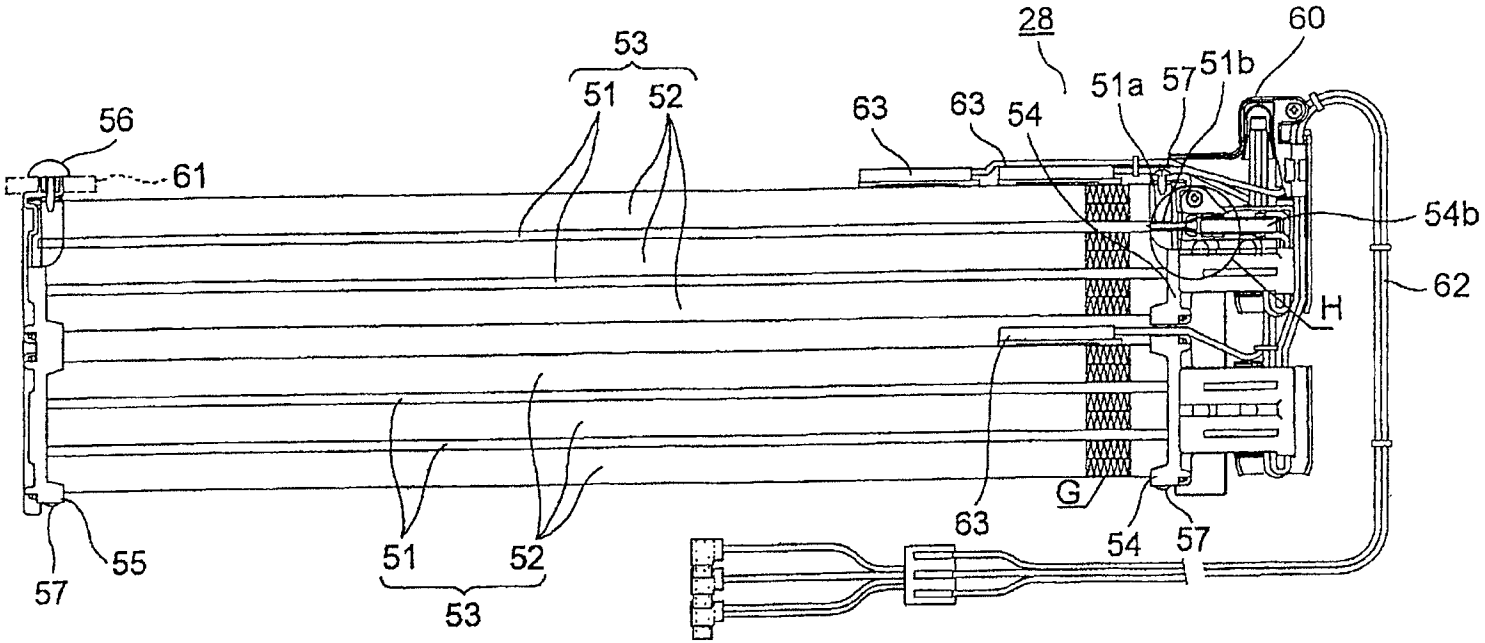
FIG. 5 is a front view of a heater unit of the air conditioner according to the first embodiment of the invention.
Figure 6:
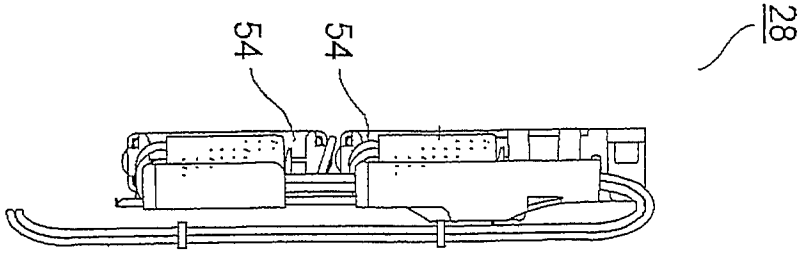
FIG. 6 is a side view of the heater unit of the air conditioner according to the first embodiment of the invention.

FIGS. 5 and 6 are a front view and a right sectional view, respectively, of the heater unit 28. The heater unit 28 is a single unit having a plurality of heaters 53 that extend in the left/right direction, with their right end parts and left end parts held by holders 54 and 55, respectively. In the heater 53, heat generators 51 that generate heat and fins 52 that exchange heat with the air flowing through the air passage 23 are arranged alternately and fixed together.

Figure 9:
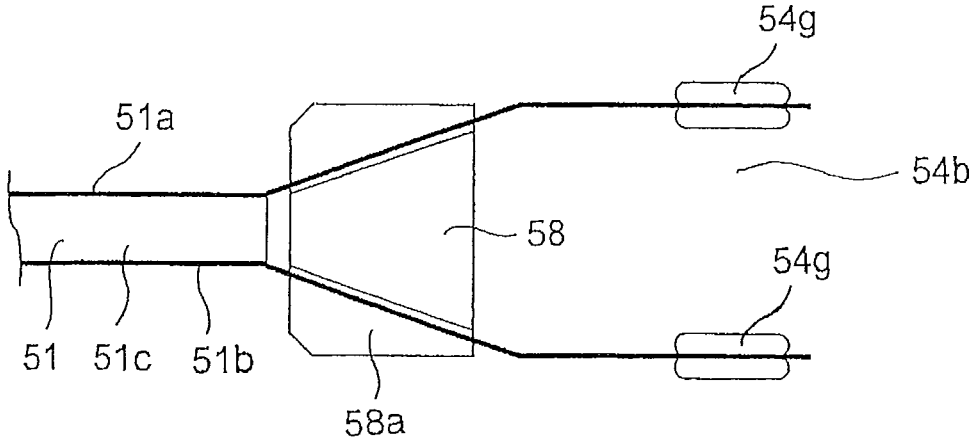
FIG. 9 is an enlarged view of part H in FIG. 5.

Each of the heat generators 51 comprises a PTC (positive temperature coefficient) heater in which opposing first and second electrodes 51*a* and 51*b* sandwich a semiconductor device 51*c* (see FIG. 9). As shown in part G, each of the fins 52 is formed into a honeycomb-shape to allow ventilation. A temperature sensor 63 is provided to be in contact with the fin 52, and based on the detection by the temperature sensor 63, the driving of the heater 53 is controlled.

The temperature sensor 63 is provided to be in contact with the fin 52 above the heat generator 51. In this way, in a case where the blower fan 25 fails to operate, early detection of abnormal heating is possible by the temperature sensor 63 since heat tends to travel upward than downward.

Figure 7:
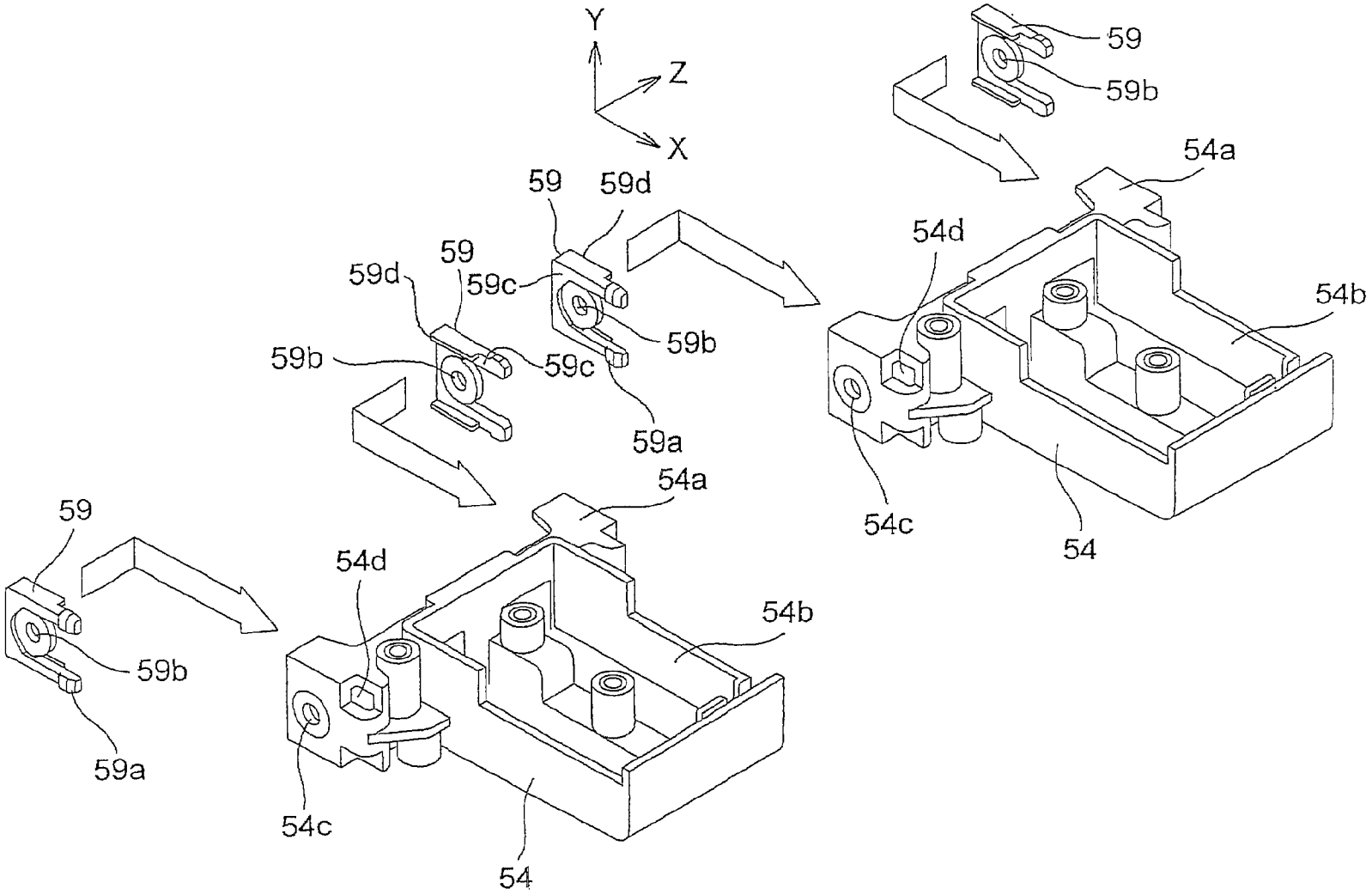
FIG. 7 is a perspective view of a right holder of the heater unit of the air conditioner according to the first embodiment of the invention.

FIG. 7 is a perspective view of the right holder 54. In the diagram, the X direction indicates the left/right direction, the Y direction indicates the front/rear direction, and the Z direction indicates the up/down direction. A plurality of holders 54 are provided to correspond to the plurality of heaters 53, which are provided one above another, the holders 54 each holding a heater 53. The holders 54 are integrally held by a bracket 60 (see FIG. 5). As will be described below, the bracket 60 is fitted to the inner surface of the air duct 24.

The holder 54 has a fitting part 54*a* fitted to the heater 53, and a terminal portion 54*b* to which the first and second electrodes 51*a* and 51*b* are connected. To the top and bottom inner surfaces of the fitting part 54*a*, a spacer 59 is fitted. The spacer 59 has a square-cornered C section formed by vertical parts 59*d* extending vertically from the front and rear ends of a horizontal part 59*c* provided horizontally along the top and bottom inner surfaces of the fitting part 54*a*.

In the top and bottom surfaces of the fitting part 54*a*, engagement holes 54*d* are provided; on the horizontal part 59*c* of the spacer 59, engagement claws 59*a* that engage with the engaging holes 54*d* are provided. The spacer 59 is inserted into the fitting part 54*a* and locked by the engagement of the engagement holes 54*d* with the engagement claws 59*a*. In this way, the heater 53 can be fitted to the holder 54 in which the spacer 59 is previously locked, facilitating the assembly of the heater unit 28.

In the fitting part 54*a* and the spacer 59, holes 54*c* and 59*b* are formed respectively. A screw 57 (see FIG. 5) inserted into the holes 54*c* and 59*b* is screwed into the heater 53, so that the heater 53 is held by the holder 54. Here, between the heater 53 and the inner surface of the fitting part 54*a*, the spacer 59 is disposed. Thus, the heater 53 is disposed to be in contact with the horizontal part 59*c* and the vertical parts 59*d* of the spacer 59, and to be apart from the top/bottom and front/rear inner surfaces of the fitting part 54*a*. In addition, the heater 53 is fastened with screws such that a predetermined amount of gap is provided between the heater 53 and the bottom surface of the fitting part 54*a* (the terminal portion 54*b*-side inner surface) that faces a side end surface of the heater 53.

The spacer 59 that makes contact with the heater 53 is formed of material with high heat-resistance and high flame-retardance that does not deform or ignite even when the heating temperature of the heater 53 is higher than during normal use due to abnormalities. Thanks to the provision of the spacer 59, the holder 54 is not in direct contact with the heater 53, and thus less heat conducts to the holder 54 than to the spacer 59. Thus, for the holder 54, it is possible to use material of which one or both of the heat-resistance and the flame-retardance are lower than the spacer 59. Here, the holder 54 is formed of material with heat-resistance or flame-retardance lower than that of the spacer 59 but with heat-resistance and flame-retardance high enough to prevent deformation or ignition against the heat conducted when the heating temperature of the heater 53 is higher than during normal use due to abnormalities.

For example, the spacer 59 is formed of PPS (polyphenylene sulfide) resin, and the holder 54 is formed of PPE (poly-phenylene-ether) resin. PPS resin has heat resistance of about 260° C. and flame retardance of UL standard 94 rating 5V. PPE resin has heat resistance of about 130° C. and flame retardance of UL standard 94 rating 5V, and is less expensive than PPS resin. So long as sufficient safety can be secured, PPE resin (for example, with heat resistance of about 130° C. and flame retardance of UL standard 94 rating V-0), of which the heat-resistance and the flame-retardance are lower than PPS resin, may be used.

This makes it possible to dispose the spacer 59 having higher heat-resistance and flame-retardance in a part in contact with the heater 53, and to use material that has lower heat-resistance and flame-retardance than the spacer 59 and is less expensive for the holder 54, which has a large volume. Accordingly, it is possible to reduce the costs of the heater unit 28 and the air conditioner 1.

Figure 8:
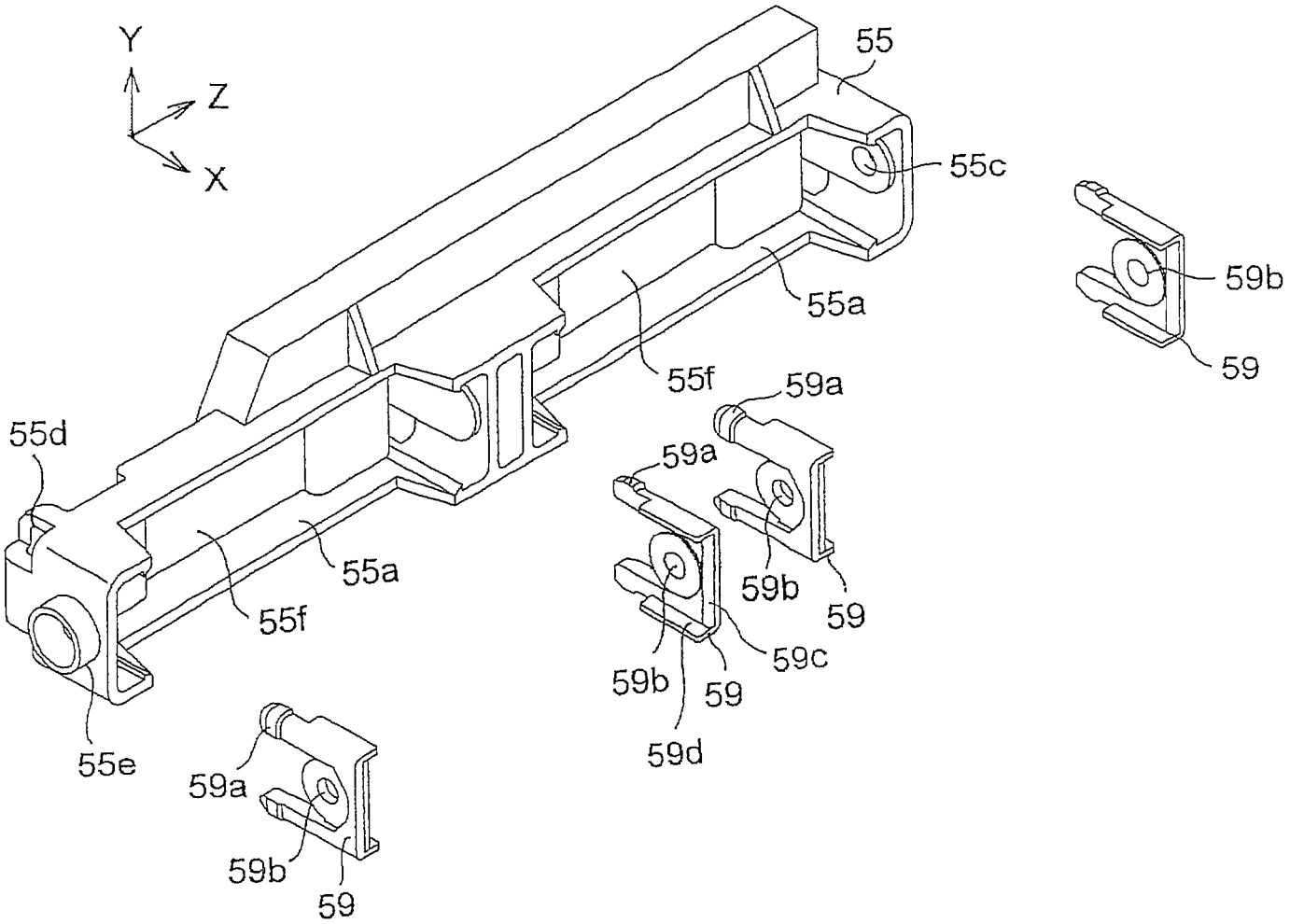
FIG. 8 is a perspective view of a left holder of the heater unit of the air conditioner according to the first embodiment of the invention.

FIG. 8 is a perspective view of the left holder 55. In the diagram, the X-direction indicates the left/right direction, the Y-direction indicates the front/rear direction, and the Z-direction indicates the up/down direction. The holder 55 has a plurality of fitting parts 55*a*, provided one above another, that each fit to one of the plurality of heaters 53 disposed one above another. On the top and bottom inner surfaces of the fitting part 55*a*, the same spacer 59 as described above is fitted. In the same manner as described above, engagement holes 55*d* are provided in the top and bottom surfaces of each fitting part 55*a*, and the spacer 59 inserted into the fitting part 55*a* is locked by the engagement of the engagement holes 55*d* with the engagement claws 59*a*.

In the top and bottom surfaces of the holder 55, threaded holes 55*c* are formed. The screws 56 and 57 (see FIG. 5) that are inserted into the threaded holes 55*c* and 59*b* are screwed into the heater 53 such that the heater 53 is held by the holder 55. Here, around the threaded hole 55*c* in the top surface of the holder 55, a ring-shaped boss 55*e* is formed.

As shown in FIGS. 3 and 5 in the previous description, the boss 55*e* is inserted into a long hole 61*a* provided in a bracket 61 fitted to the inner surface of the air duct 24 as described below. Then, the screw 56 is fixed on the top surface of the boss 55*e* such that a predetermined gap is secured between the screw 56 and the bracket 61. Thus, when the heater 53 expands in the length direction (the left/right direction), the holder 55, together with the heater 53, slides and moves with respect to the bracket 61. This makes it possible to absorb expansion of the heater 53 and thereby prevent damage to the air duct 24 to which the bracket 61 is fitted.

Figure 22:
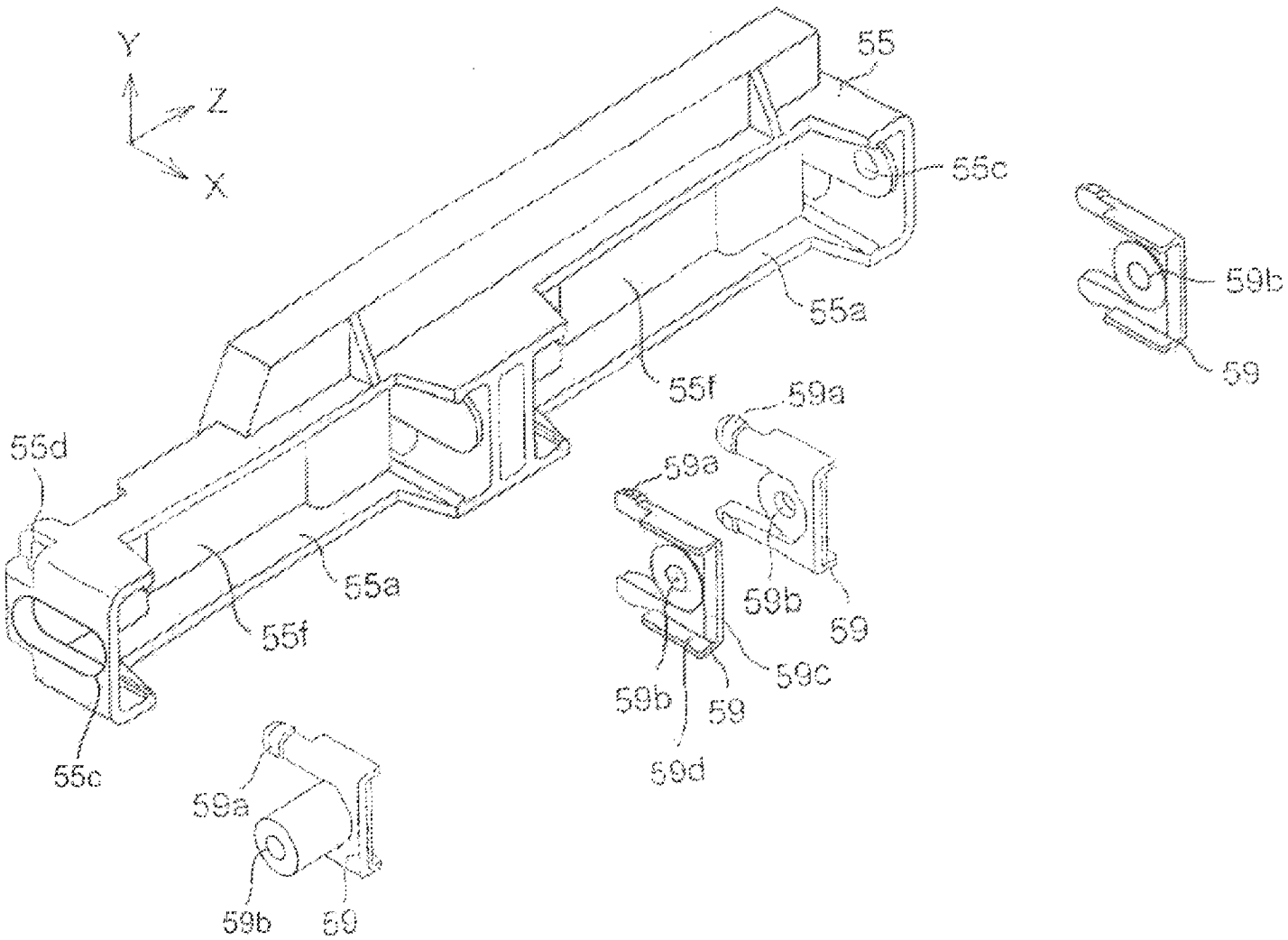
FIG. 22 is a perspective view of a modified example of a left holder of the heater unit of the air conditioner according to the first embodiment of the invention.

The right holder 54 may also be slidable with respect to the bracket 60 (see FIG. 5). Moreover, the spacer 59 integral with the heater 53 may be formed slidable with respect to the holder 55. Specifically, as shown in FIG. 22, the threaded hole 55*c* of the holder 55 is formed into a long hole, a boss that penetrates through the threaded hole 55*c* and the long hole 61*a* is provided on the spacer 59, and the screw 56 is fixed on the top surface of the boss of the spacer 59. In this way, it is also possible to absorb expansion/contraction of the heater 53.

In the same manner as described above, between the heater 53 and the inner surface of the fitting part 55*a*, the spacer 59 is disposed. Thus, the heater 53 is disposed to be in contact with the horizontal part 59*c* and the vertical parts 59*d*, and apart from the top/bottom and front/rear inner surfaces of the fitting part 55*a*. In addition, the heater 53 is fastened with screws such that a predetermined amount of gap is provided between the heater 53 and the bottom surface 55*f* of the fitting part 55*a* that faces a side end surface of the heater 53.

Like the holder 54, the holder 55 is also formed of PPE resin that has lower heat-resistance and flame-retardance than the spacer 59 and is less expensive. This makes it possible to reduce the costs of the heater unit 28 and the air conditioner 1.

For example, suppose the temperature of the heater 53 is 80° C. and the temperature conducted to the holders 54 and 55 is 60° C. during normal operation of the heater 53. When the heater 53 heats abnormally and its temperature rises to 100° C., a safety device, such as the temperature sensor 63, a temperature fuse (unillustrated), or the like, operates and supply of electric power to the heater 53 is stopped. Here, the heat conducted, due to abnormal heating, to the holders 54 and 55 is less than that to the spacer 59, and the temperature of the holders 54 and 55 rises to, for example, 80° C. at the maximum. Thus, even though the holders 54 and 55 are formed of PPE resin with lower heat-resistance and flame-retardance than the spacer 59, it is possible to prevent deformation or ignition.

The holders 54 and 55 and the spacer 59 may be formed of other materials. Although the holders 54 and 55 have lower heat-resistance than and equivalent flame-retardance to the spacer 59, it may also be formed of material that has lower heat-resistance and higher flame-retardance and is less expensive. Moreover, the holders 54 and 55 may also be formed of material that, compared with the spacer 59, has lower heat-resistance and equivalent or higher flame-retardance and is less expensive, or has lower heat-resistance and flame-retardance and is less expensive.

As an example of the above-mentioned safety devices, the temperature sensor 63 may be a self-resetting thermostat. In the self-resetting thermostat, contacts remain closed during normal operation to let current pass through but become open when the heater 53 heats abnormally and its temperature rises. Thus, supply of electric power to the heater 53 is stopped.

To further enhance safety, one-shot (one time only) temperature fuse may be used together. In this case, the temperature at which the temperature fuse operates (trips) is set higher than the temperature at which the self-resetting thermostat operates (trips). For example, a self-resetting thermostat that operates (trips) at 100° C. and a temperature fuse that operates (trips) at 130° C. are used. In this way, in case the self-resetting thermostat fails, the temperature fuse operates, making it possible to doubly secure safety.

Moreover, a thermistor may be used as the temperature sensor 63, and a control device such as a microcomputer may monitor the thermistor temperature to perform control. This makes it possible to control by software so as to stop supply of electric power when the heater 53 heats abnormally.

FIG. 9 is an enlarged view of part H in FIG. 5. At the terminal portion 54*b* of the holder 54, a plurality of terminals 54*g* that sandwich the first and second electrodes 51*a* and 51*b* extending from the heat generator 51 of the heater 28 are provided. To the terminals 54*g*, leads 62 (see FIG. 5) are connected so that electric power is supplied to the heat generator 51.

In the holder 54, near the heat generator 51, a separator 58 is fitted that keeps the first and second electrodes 51*a* and 51*b* apart in the up/down direction in the figure with a predetermined interval. The separator 58 has a floor portion 58*a* provided between the holder 54 and the first and second electrodes 51*a* and 51*b*.

In this way, the first and second electrodes 51*a* and 51*b* that are heated are disposed apart from the holder 54. Moreover, the separator 58 in contact with the first and second electrodes 51*a* and 51*b* is formed of PPS resin with high heat-resistance and high flame-retardance. It is therefore possible to reduce the costs of the heater unit 28 and the air conditioner 1. One of the heat-resistance and the flame-retardance of the holder 54 may be lower than that of the separator 58 and the other may be equivalent to that of the separator 58.

Figure 10:
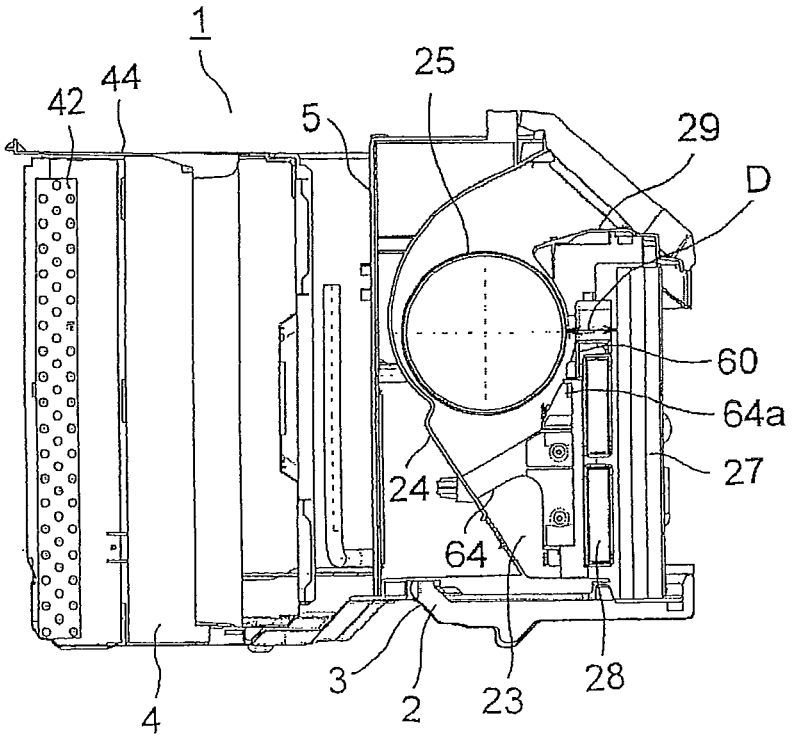
FIG. 10 is a sectional view taken along line A-A in FIG. 3.
Figure 11:
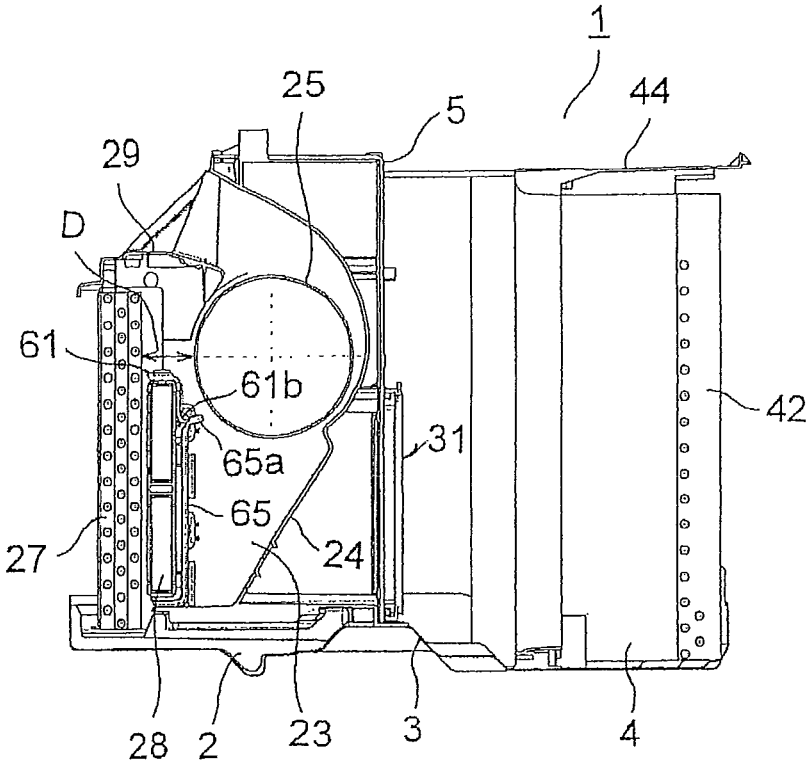
FIG. 11 is a sectional view taken along line B-B in FIG. 3.

FIGS. 10 and 11 are sectional views taken along lines A-A and B-B, respectively, in FIG. 3. To the bottom right of the air duct 24, a prop 64 is provided integrally with the air duct 24. The prop 64 projects frontward, and is provided with, in its top part, a threaded part 64*a* with a threaded hole (unillustrated). On a left floor part of the air duct 24, an angle 65 formed of metal is provided upright. The angle 65 is provided with, in its top surface, a threaded part 65*a* with a threaded hole (unillustrated).

In the brackets 60 and 61 of the heater unit 28, there are formed fixing parts 60*b* (see FIG. 3) and 61*b* having holes into which screws are inserted. The fixing parts 60*b* and 61*b* of the brackets 60 and 61 are fastened with screws to the threaded holes of the threaded parts 64*a* and 65*a* with a screwdriver inserted into a gap D between the indoor heat exchanger 27 and the blower fan 25. In this way, the heater unit 28 is fixed to the casing 20 of the indoor portion 2.

Figure 12:
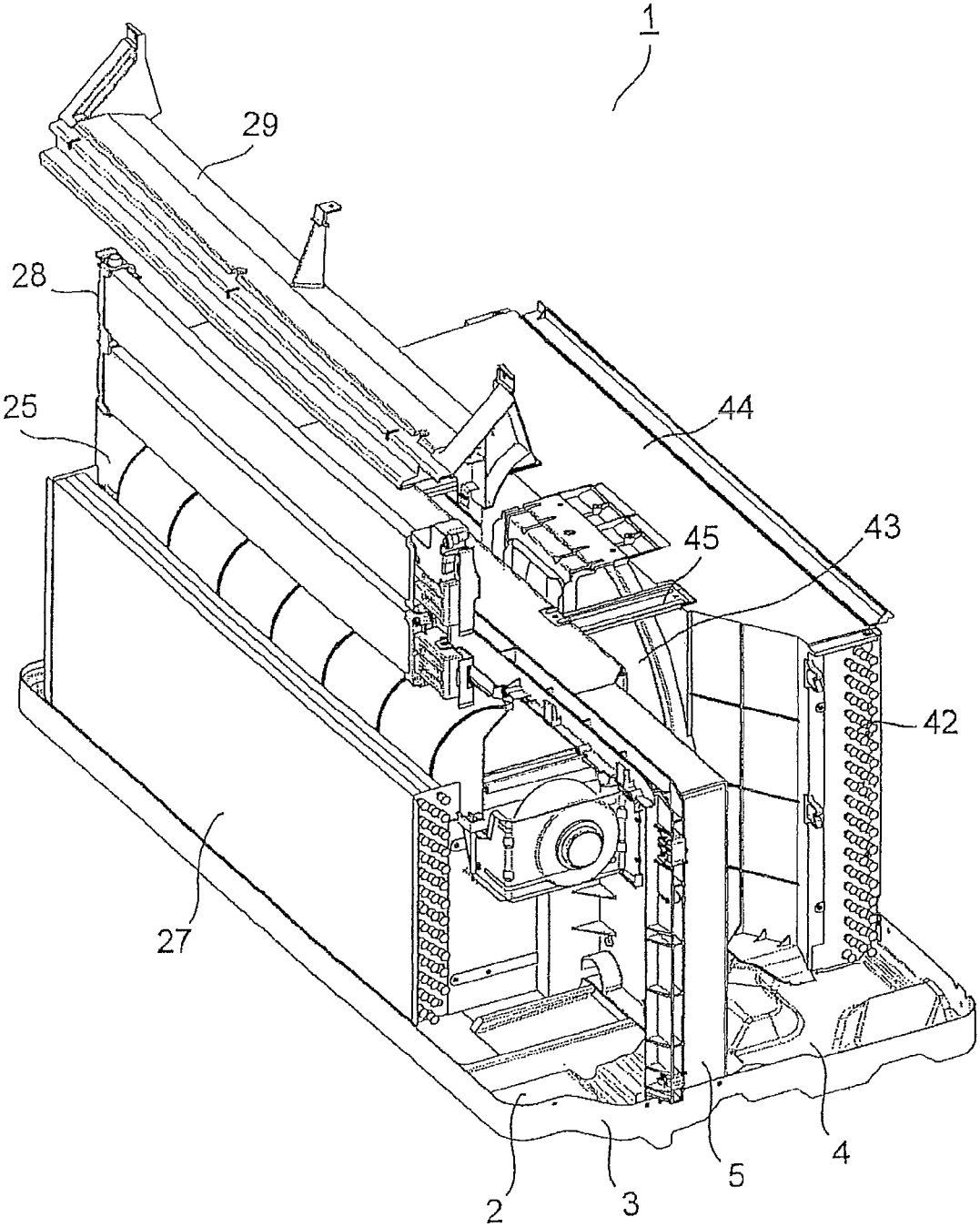
FIG. 12 is perspective view showing the air conditioner according to the first embodiment of the invention in a state when the heater unit is attached/detached.
Figure 13:
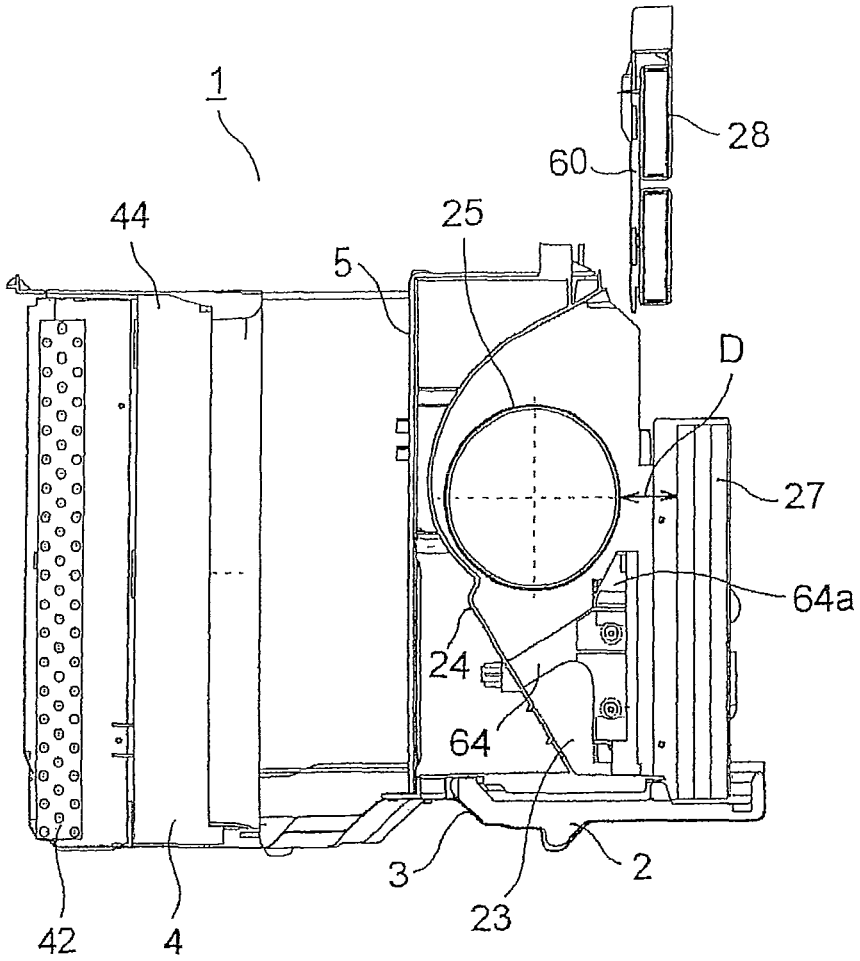
FIG. 13 is a sectional view taken along line A-A in FIG. 3 showing the air conditioner according to the first embodiment of the invention in a state when the heater unit is attached/detached.
Figure 14:
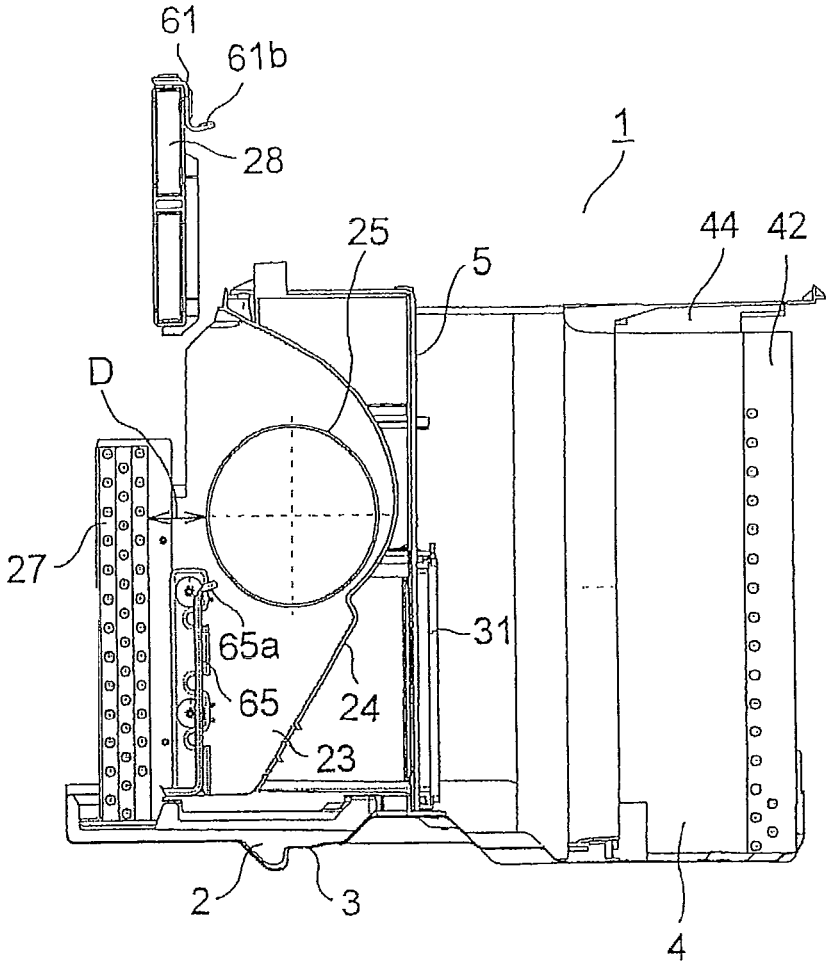
FIG. 14 is a sectional view taken along line B-B in FIG. 3 showing the air conditioner according to the first embodiment of the invention in a state when the heater unit is attached/detached.

FIG. 12 is a perspective view of the air conditioner 1 in a state when the heater unit 28 is attached/detached. FIGS. 13 and 14 are sectional views at that time, taken along lines A-A and B-B in FIG. 3. At the time of attaching/detaching the heater unit 28, the outer cover 30 (see FIG. 2) and the duct member 29 are removed.

Then, the screws fixing the brackets 60 and 61 are unscrewed, and the heater unit 28 is removed upward along the indoor heat exchanger 27 through the gap D between the indoor heat exchanger 27 and the blower fan 25. On the other hand, the heater unit 28 is inserted from above along the indoor heat exchanger 27 through the gap D between the indoor heat exchanger 27 and the blower fan 25, and then the brackets 60 and 61 are screwed on.

In this way, without removing the indoor heat exchanger 27 connected to the compressor 41 (see FIG. 1) via the refrigerant pipe 47, the heater unit 28 can be attached/detached. It is therefore possible to easily attach the heater unit 28 during assembly of the air conditioner 1, and to easily replace the heater unit 28 when there is a failure.

Figure 15:
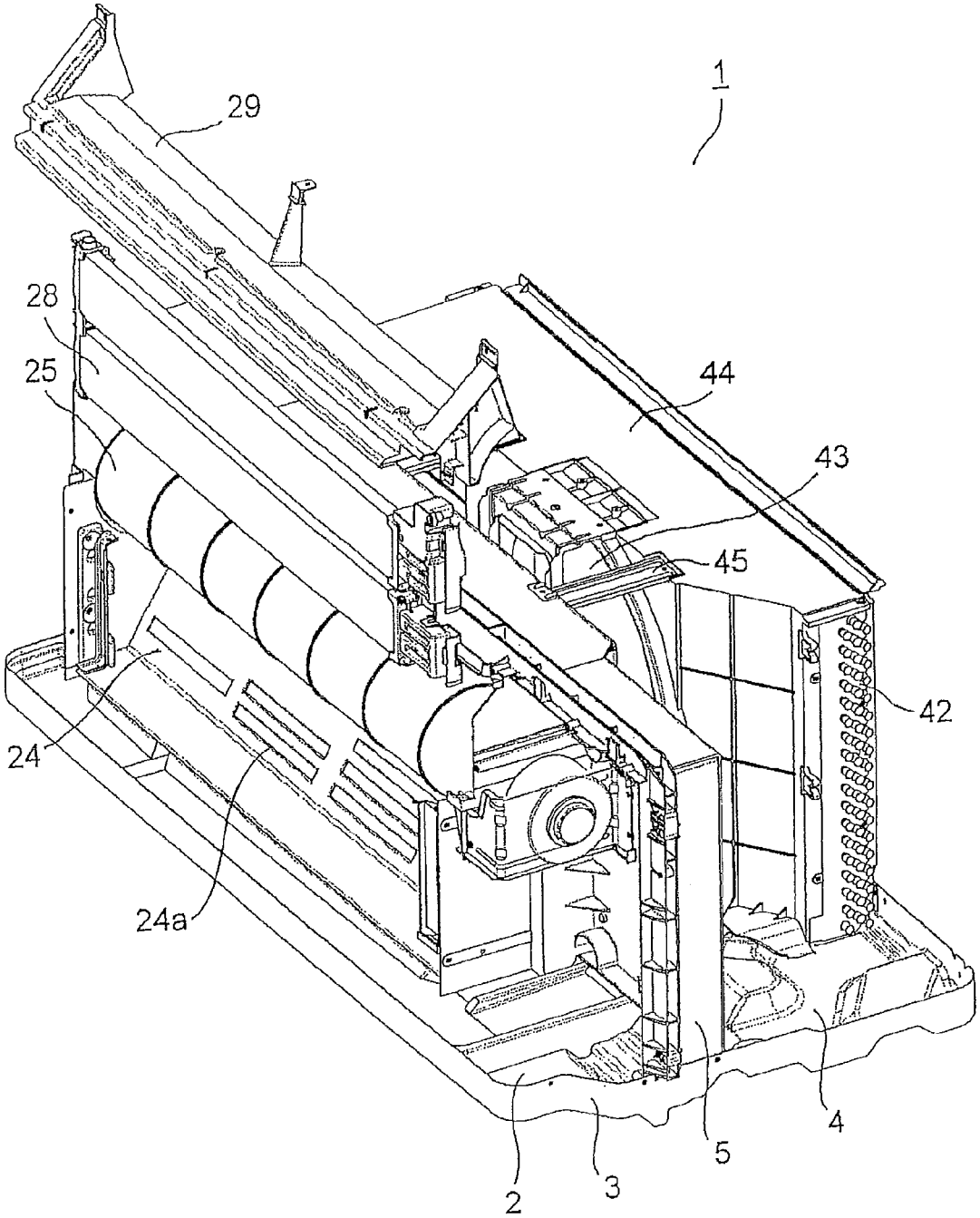
FIG. 15 is the same perspective view as FIG. 12 except that an indoor heat exchanger is omitted.
Figure 16:
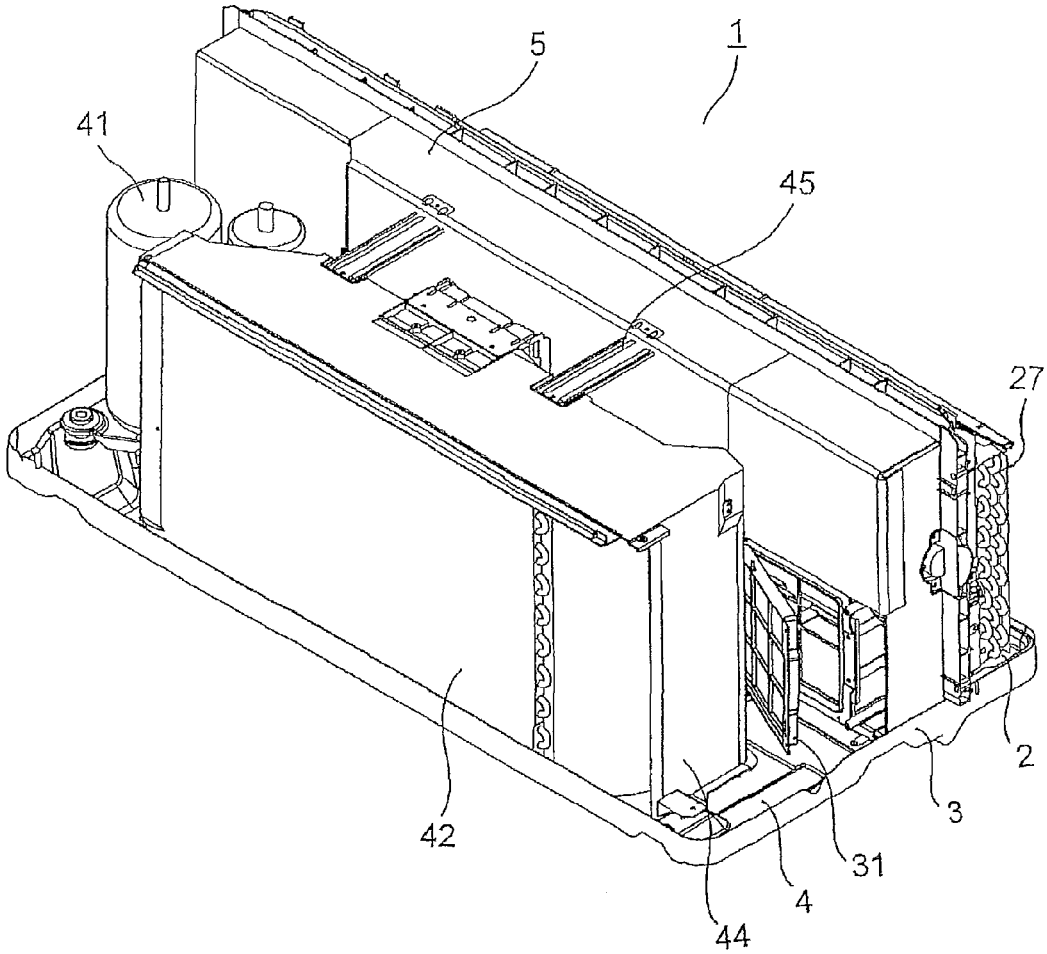
FIG. 16 is a rear perspective view showing the air conditioner according to the first embodiment of the invention in a state in which a ventilation damper is opened.

FIG. 15 is the same perspective view as FIG. 12 except that the indoor heat exchanger 27 is omitted. In the rear surface of the air duct 24, a plurality of rectangular openings 24*a* are provided. As shown in a rear perspective view of FIG. 16, when the blower fan 25 operates with the ventilation damper 31 open, outside air flows, via the openings 24*a*, into the air passage 23, and thus the room is ventilated.

Figure 17:
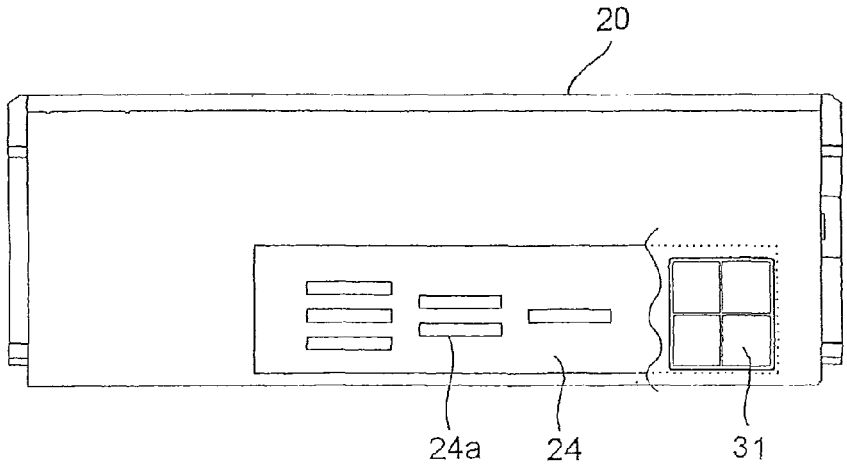
FIG. 17 is a rear view of an indoor portion of the air conditioner according to the first embodiment of the invention.

FIG. 17 is a rear view of the casing 20 of the indoor portion 2. The opening area per unit area of the openings 24*a* is larger at the downwind side than at the upwind side at the down stream side of the ventilation damper 31 arranged lopsidedly toward the left (in the rear view of FIG. 17, toward the right). In this way, it is possible to make the amount of outside air flowing, via the openings 24*a*, into the air passage 23 (see FIG. 2) even in the left/right direction. It is therefore possible to alleviate uneveness in, and thereby make even, the amount of air flowing through the air passage 23. Accordingly, it is possible to reduce noise generated when the amount of air is uneven.

Figure 18:
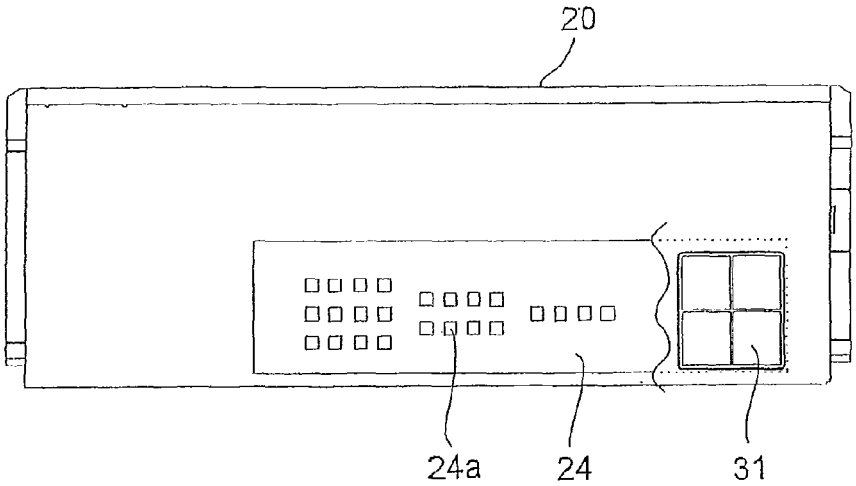
FIG. 18 is a rear view of the indoor portion having other openings in an air duct of the air conditioner according to the first embodiment of the invention.
Figure 19:
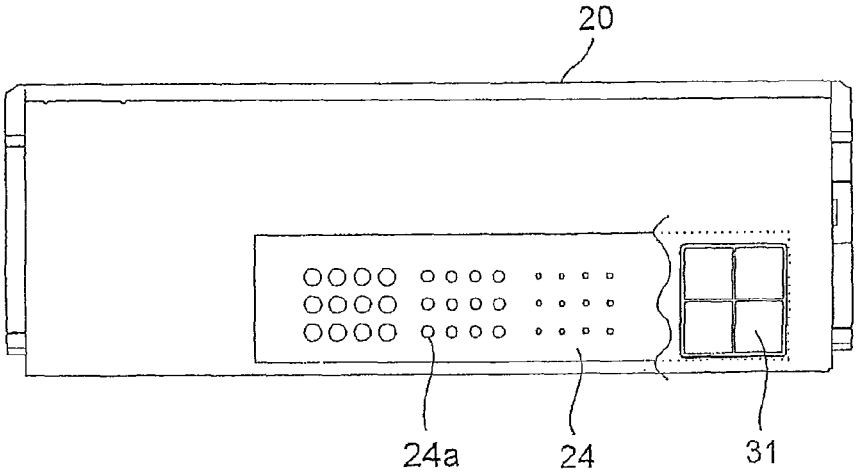
FIG. 19 is a rear view of the indoor portion having other openings in the air duct of the air conditioner according to the first embodiment of the invention.

As shown in FIGS. 18 and 19, the openings 24*a* may be square, circular, or any other shape.

In the air conditioner 1 with the structure described above, when cooling operation starts, the compressor 41 is driven to operate the refrigerating cycle. Thereby, the indoor heat exchanger 27 serves as the cold-side evaporator of the refrigerating cycle, and the outdoor heat exchanger 42 serves as the hot-side condenser. The outdoor heat exchanger 42 is cooled by the outdoor fan 43 to dissipate heat. As the blower fan 25 is driven, the air inside the room flows through the air inlet 21 into the air passage 23, and the air has its temperature lowered by heat exchange with the indoor heat exchanger 27, and is then blown into the room through the air outlet 22. In this way, the room is cooled.

When heating operation starts, the compressor 41 is driven to operate the refrigerating cycle. Thereby, the indoor heat exchanger 27 serves as the hot-side condenser of the refrigerating cycle, and the outdoor heat exchanger 42 serves as the cold-side evaporator. The outdoor heat exchanger 42 has its temperature raised by the outdoor fan 43. As the blower fan 25 is driven, the air inside the room flows through the air inlet 21 into the air passage 23, and the air has its temperature raised by heat exchange with the indoor heat exchanger 27.

When the heater 53 is driven, the air in the air passage 23 has its temperature raised further. Here, since the air flowing through the air passage 23 exchanges heat with the fin 52 of the heater 53, it is possible to prevent the heat generator 51 that comprises a PTC heater from generating less heat due to overheating. It is therefore possible to increase heating efficiency.

Moreover, the blower fan 25 and the indoor heat exchanger 27 are formed to extend laterally further than the heater 53, and face the terminal portion 54*b* of the holder 54 of the heater unit 28. In this way, it is possible to make the heat exchange area of the indoor heat exchanger 27 large and in addition cool the terminal portion 54*b* by air flow.

The air having its temperature raised by the indoor heat exchanger 27 and the heater 53 is blown out through the air outlet 22 into the room to heat the room. It is also possible, during the heating operation, to stop the compressor 41 and raise the temperature of the air by the heater 53 alone. Moreover, it is also possible to provide the heater 53 in a one-unit type air conditioner dedicated to cooling that can only perform cooling by operation of the refrigerating cycle, so as to enable it to perform the heating operation by the heater 53.

When the ventilation damper 31 is opened, as the blower fan 25 is driven, outside air flows, via the openings 24*a* of the air duct 24, into the air passage 23. Thus, the air that has exchanged heat with the indoor heat exchanger 27 or the heater 53 is mixed with the outside air and blown into the room. Accordingly, the room can be ventilated.

According to this embodiment, at least one of the heat-resistance and the flame-retardance of the spacer 59 that is in contact with the heater 53 and disposed between the holders 54 and 55 and the heater 53 is higher than that of the holders 54 and 55. Thus, it is possible to use material with higher heat-resistance and flame-retardance for the spacer 59, and make the heat-resistance or the flame-retardance of the holders 54 and 55 lower. It is therefore possible to reduce use of expensive material and hence the cost of the air conditioner 1. Note that a similar effect is also achieved when a heater 53 provided with no fin 52 is held by the holders 54 and 55.

Since the holder 55 is slidably fitted with respect to the bracket 61 that fits the left holder 55 to the casing 20, it is possible to absorb expansion of the heater 53 due to heating and thereby prevent damage to the air duct 24 inside the casing 20 to which the bracket 61 is fitted. Likewise, the right holder 54 may be slidable with respect to the bracket 60. The spacer 59 integral with the heater 53 may also be slidable with respect to the holder 55.

Since the spacer 59 has the engagement claws 59*a* that engage with the holders 54 and 55, it is possible to hold the heater 53 by the holders 54 and 55 with the spacer 59 fitted to the holders 54 and 55. It is therefore possible to easily assemble the heater unit 28.

Since at least one of the heat-resistance and the flame-retardance of the separator 58 that keeps apart the opposing first and second electrodes 51*a* and 51*b* of the PTC heater is higher than that of the holders 54 and 55, it is possible to use material with higher heat-resistance and flame-retardance for the separator 58 and make the heat-resistance or the flame-retardance of the holders 54 and 55 lower. It is therefore possible to further reduce the cost of the air conditioner 1.

Since the spacer 59 and the separator 58, both in contact with the heater 53, are formed of PPS resin, it is possible to achieve high heat-resistance and flame-retardance. Moreover, since the holders 54 and 55 are formed of PPE resin, it is possible to form with less cost.

When the outer cover 30 is removed, the heater unit 28 can be taken out and put in along the indoor heat exchanger 27 through the gap D between the blower fan 25 and the indoor heat exchanger 27; thus, when there is a failure with the heater 53, without removing the indoor heat exchanger 27, the heater unit 28 can be taken out and put in easily for replacement. It is therefore possible to perform maintenance of the air conditioner 1 easily.

The heat generator 51 comprises the PTC heater, and the heater 53 has the fin 52 fixed to the heat generator 51; thus, it is possible, by heat exchange between the air flowing through the air passage 23 and the fin 52, to prevent a lowering in the amount of heat generated due to overheating of the PTC heater.

Through the gap D, the heater unit 28 is fastened with screws to the air duct 24 inside the casing 20 of the indoor portion 2; thus, it is possible to attach/detach the heater unit 28 easily.

The terminal portion 54*b*, to which the first and second electrodes 51*a* and 51*b* of the heat generator 51 are connected, is disposed at one end of the heater unit 28, and the blower fan 25 and the indoor heat exchanger 27, both extending in the left/right direction, are arranged to face the terminal portion 54; thus, it is possible to make the heat exchange area of the indoor heat exchanger 27 large and in addition to cool the terminal portion 54*b* by air flow.

The duct member 29, which forms the lower wall in the air passage 23 near the air outlet 22 arranged above the air inlet 21, is provided in an attachable/detachable manner, and, with the duct member 29 detached, the heater unit 28 is taken out to and put in from above; thus, the heater unit 28 can be easily taken out to and put in from above along the indoor heat exchanger 27.

The opening area per unit area of the openings 24*a* that are provided in the rear surface of the air duct 24 is larger at the downwind side than at the upwind side at the down stream side of the ventilation damper 31, and thus outside air flows evenly into the air passage 23 through the openings 24*a*. It is therefore possible to alleviate unevenness in, and thereby make even, the amount of air flowing through the air passage 23. Accordingly, it is possible to reduce noise generated when the amount of air is uneven.

The ventilation damper 31 is arranged lopsidedly toward one end part in the left/right direction away from the outdoor fan 43 immersed in the condensed water collected on the base plate 3; thus, it is possible to prevent water from entering the indoor portion 2.

In this embodiment, although the heater unit 28 is taken out to and put in from above, the heater unit 28 may be taken out to and put in from below or from a side along the indoor heat exchanger 27. Moreover, although a description is given of the air conditioner 1 in which the indoor portion 2 is integral with the outdoor portion 4, the air conditioner 1 may be of a type in which the indoor portion 2 is separate from the outdoor portion 4.

Figure 20:
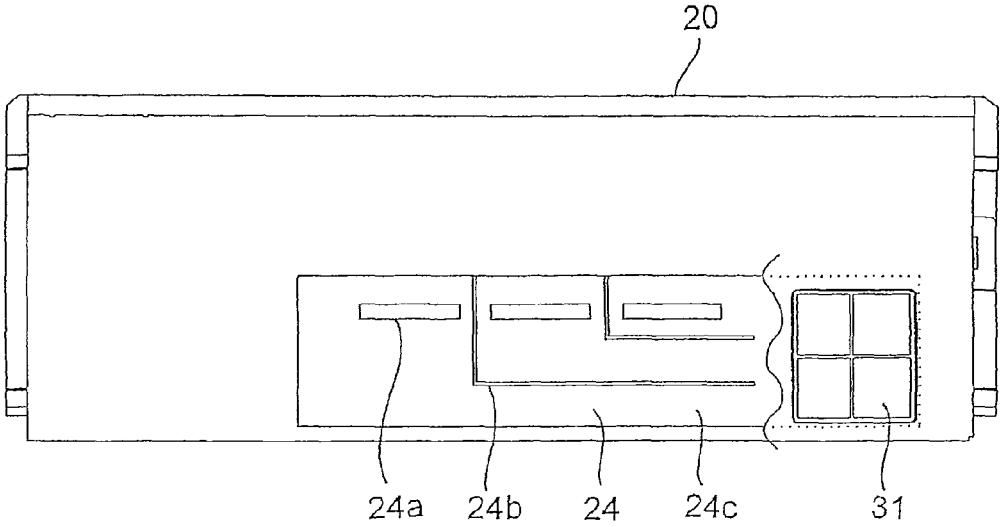
FIG. 20 is a rear view of an indoor portion according a second embodiment of the invention.

Next, FIG. 20 is a rear view showing a casing 20 of an indoor portion 2 of an air conditioner 1 according to a second embodiment. For convenience of description, such parts in the figure as find their counterparts in the above-described first embodiment shown in FIGS. 1 to 19 are identified with the same reference symbols. This embodiment differs from the first embodiment in the structure of a flow passage between openings 24*a* provided in an air duct 24 and a ventilation damper 31. In other respects, this embodiment is the same as the first embodiment.

Between the air duct 24 and a partition wall 5, there are provided a plurality of divided paths 24*c* divided by ribs 24*b* to have a substantially equal area. The ribs 24*b* are formed integral with the air duct 24. In the air duct 24, a plurality of openings 24*a* are provided in a line in the left/right direction, and the openings 24*a* are connected to a ventilation damper 31 by the divided paths 24*c*.

In this way, it is possible to make the amount of outside air flowing through the openings 24*a* into the air passage 23 (see FIG. 2) even in the left/right direction. It is therefore possible to alleviate unevenness in, and thereby make even, the amount of air flowing through the air passage 23. Thus, it is possible to reduce noise generated when the amount of air is uneven.

According to this embodiment, the plurality of divided paths 24*c* are provided that each introduce outside air through the ventilation damper 31 into one of the plurality of openings 24*a* provided in the rear surface of the air duct 24, and thus the outside air flows evenly into the air passage 23 through the openings 24*a*. It is therefore possible to alleviate unevenness in, and thereby make even, the amount of air flowing through the air passage 23. Accordingly, it is possible to reduce noise generated when the amount of air is uneven.

Figure 21:
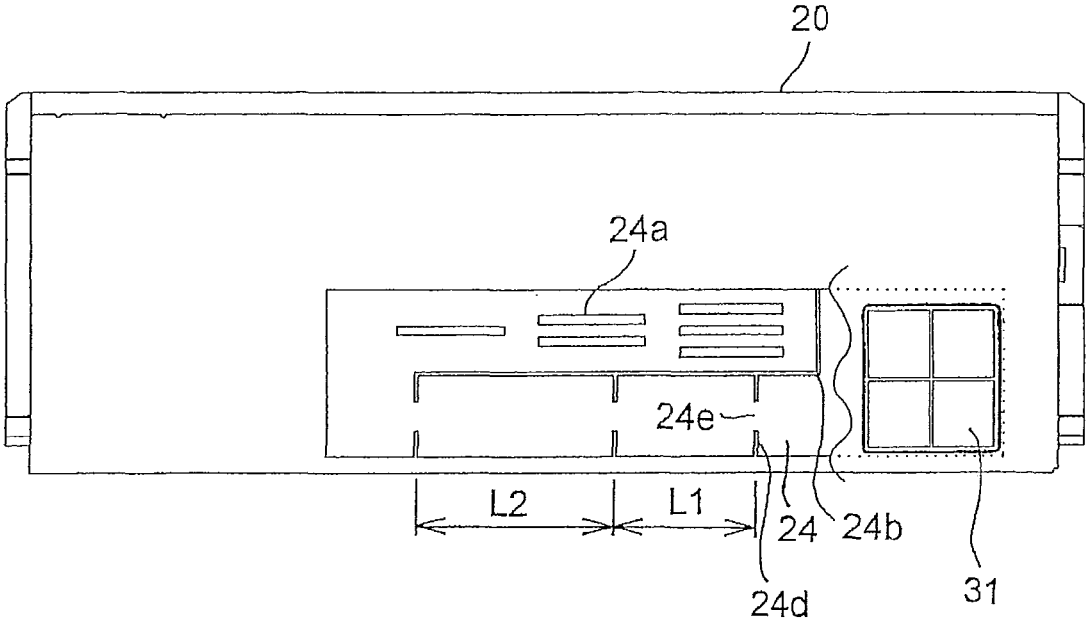
FIG. 21 is a rear view of an indoor portion according a third embodiment of the invention.

Next, FIG. 21 is a rear view showing a casing 20 of an indoor portion 2 of an air conditioner 1 according to a third embodiment. For convenience of description, such parts in the figure as find their counterparts in the above-described first embodiment shown in FIGS. 1 to 19 are identified with the same reference symbols. This embodiment differs from the first embodiment in the structure of a flow passage between the openings 24*a* provided in an air duct 24 and a ventilation damper 31. In other respects, this embodiment is the same as the first embodiment.

Between the air duct 24 and a partition wall 5, there is formed a flow passage that is bent in a U-shape by a rib 24*b*. The rib 24*b* is formed integral with the air duct 24. The opening area per unit area of the openings 24*a* is larger at the downwind side than at the upwind side at the down stream side of a ventilation damper 31. In this way, as in the first embodiment, it is possible to alleviate unevenness in, and thereby make even, the amount of air flowing through the air passage 23. Accordingly, it possible to reduce noise generated when the amount of air is uneven.

Inside the flow passage between the ventilation damper 31 and the openings 24*a*, a plurality of shielding plates 24*d* that have a small hole 24*e* are provided. By the shielding plates 24*d*, a muffler (silencer) is formed, which makes it possible to further reduce noise of the air stream flowing in through the ventilation damper 31. Moreover, three or more shielding plates 24*d* are provided and arranged at a plurality of intervals L1 and L2. In this way, it is possible to weaken sounds of a plurality of frequencies, and thus to further reduce noise. The shielding plates 24*d* may also be provided inside the divided path 24*c* (see FIG. 20) of the second embodiment.

According to this embodiment, the plurality of shielding plates 24*d* having a small hole 24*e* are provided in the flow passage between the ventilation damper 31 and the openings 24*a*; thus, it is possible to further reduce noise of the air stream flowing in through the ventilation duct 31.

Moreover, the shielding plates 24*d* are arranged at the plurality of intervals L1 and L2; thus, it is possible to weaken sounds of a plurality of frequencies, and thus to further reduce noise. Note that four or more shielding plates 24*d* may be provided.

It is to be understood that the present invention may be carried out in any other manner than specifically described above as embodiments, and many modifications and variations are possible within the scope of the present invention.

What is claimed is:

1. An air conditioner comprising:

a casing having an air inlet and an air outlet;

a heater disposed inside the casing to heat air having flowed through the air inlet into the casing;

a first holder indirectly holding the heater;

a bracket fitting the first holder to the casing; and a spacer disposed between the first holder and the heater to directly hold the heater, wherein at least one of heat-resistance and flame-retardance of the spacer is higher than that of the first holder, the heater is formed to extend in one direction, and one end of the heater in a longitudinal direction of the heater is held by the first holder via the spacer, a boss is formed on the spacer, the first holder has a long hole, the bracket has a long hole, the boss penetrates through the first long hole in the first holder and the long hole in the bracket, the screw is fixed on a top surface of the boss, and the spacer fixed to the heater is provided to be slidable with respect to the first holder.

2. The air conditioner according to claim 1, further comprising:

a second holder holding another end of the heater.

* * * * *